United States Patent [19]

Hollenstein

[11] Patent Number: 4,875,747

[45] Date of Patent: Oct. 24, 1989

[54] DRAWER

[75] Inventor: Helmut Hollenstein, Lustenau, Austria

[73] Assignee: Julius Blum Gesellschaft m.b.H., Höchst, Austria

[21] Appl. No.: 272,248

[22] Filed: Nov. 17, 1988

[30] Foreign Application Priority Data

Dec. 24, 1987 [AT] Austria ..... 3431/87

[51] Int. Cl.[4] ..... A47B 88/00

[52] U.S. Cl. ..... 312/330.1; 403/282

[58] Field of Search ..... 312/330 R, 330 SM; 403/282, 283, 354, 381; 24/590, 685, 697

[56] References Cited

U.S. PATENT DOCUMENTS 3,639,027 2/1972 Higdon, Jr. ..... 312/330 R

FOREIGN PATENT DOCUMENTS 2243126 3/1974 Fed. Rep. of Germany ... 312/330 R
2702217 7/1978 Fed. Rep. of Germany ... 312/330 R
277940 12/1951 Switzerland ..... 312/330 R

*Primary Examiner*—Kenneth J. Dorner
*Assistant Examiner*—Brian K. Green
*Attorney, Agent, or Firm*—Wenderoth, Lind & Ponack

[57] ABSTRACT

A drawer has metal drawer side walls including vertical flanges which form the lateral limitations of the drawer. The drawer side walls have at their lower sides horizontal respective flanges on which a bottom plate, e.g. of chip board, abuts. Punched from the horizontal flanges of the drawer side walls are a number of flaps which project into continuous grooves of the bottom plate which extend parallel to the lateral edges thereof. In the longitudinal direction of the drawer side wall, the flaps at each side are aligned obliquely to the respective groove.

5 Claims, 2 Drawing Sheets

DRAWER

FIELD AND BACKGROUND OF THE INVENTION

The invention relates to a drawer with metal drawer side walls having vertical flanges which form the lateral limitations of the drawer. Each drawer side wall has at their lower side thereof a horizontal flange on which a bottom plate of wood or the like abuts. A number of flaps are punched out from the horizontal flanges and project into continuous grooves provided in the bottom plate and extending parallel to the lateral edges of the bottom plate.

Generally, L-, U- or Z-shaped profile rails are fastened to the side walls of a drawer and form the pull-out rails of a pull-out guide assembly.

A drawer is known from DE-OS No. 27 02 217 in which the side walls are made of metal. The drawer side walls have Z-shaped profiles, and the upper horizontal flanges serve as running flanges for supporting rollers at the sides of a furniture body and thus replace separate pull-out rails.

Hooks which project into openings of the bottom plate are bent out from the lower horizontal flanges.

An identical drawer has been described in published British Patent Application No. 2,169,491.

SUMMARY OF THE INVENTION

It is the object of the invention to improve a drawer of the above-described type, wherein the anchoring between the bottom plate and the drawer side walls is improved and a firm fit between the parts of the drawer is obtained.

According to the invention, this is achieved by aligning the flaps obliquely with respect to the groove, relative to the longitudinal direction of the drawer side wall, so that the corners of the flaps are pressed into the edges of the bottom plate which limit and define the groove.

Due to the fact that the ends and edges of the flaps are pressed into the side walls of the groove, when the bottom plate is disposed on the horizontal flanges of the drawer side walls, a clamping effect is obtained which acts particularly in the longitudinal direction of the drawer, i.e. in the direction in which the greatest forces occur, when the drawer is closed and opened.

It is advantageously provided that the flaps are parallel to one another and that the corresponding vertical edges at the corners of the flaps lie on a common straight line.

Thus the corners of the flaps are uniformly pressed into the bottom plate, and the edges of the groove are prevented from being pressed apart.

BRIEF DESCRIPTION OF THE FIGURES OF THE DRAWINGS

In the following an embodiment of the invention will be described in more detail with reference to the accompanying drawings, in which.

Figure 1:
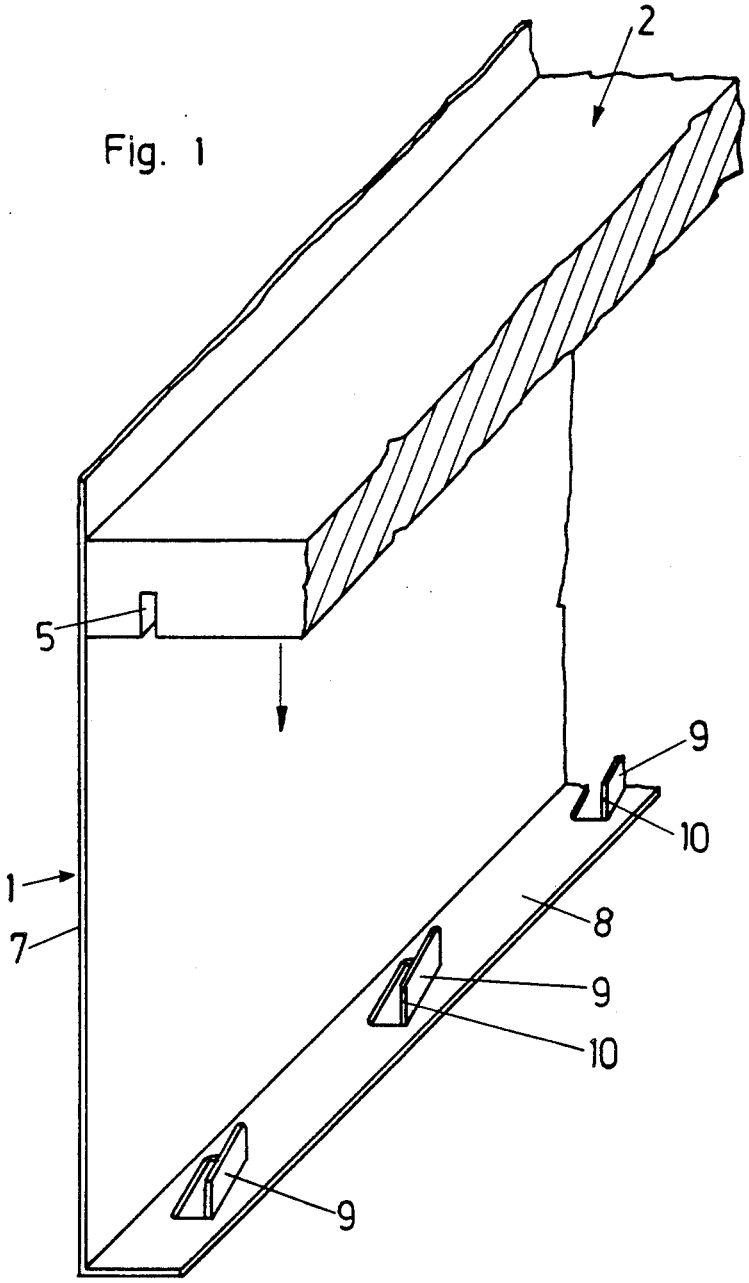
FIG. 1 is a perspective of a portion of a side wall and a bottom plate according to the invention.
Figure 2:
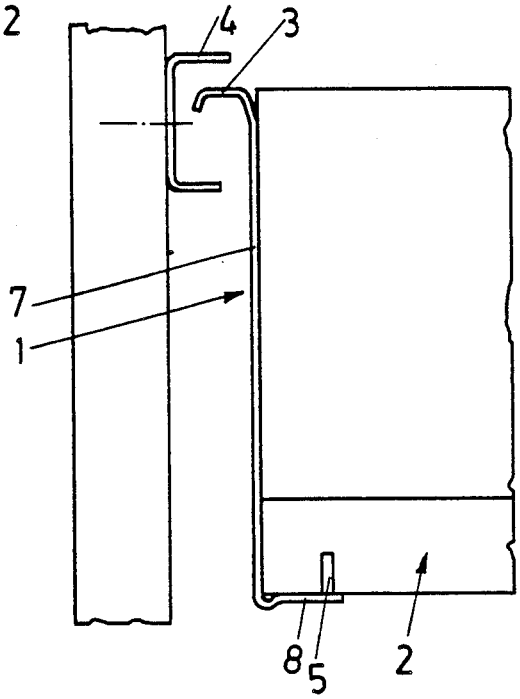
FIG. 2 is a vertical sectional view of the drawer side wall and the bottom plate.

In the drawings, a drawer side wall 1 as well as the part of the bottom plate 2 are schematically shown. The other side of the drawer is analogous. The rear wall and the front plate as well as their connections with the drawer side walls 1 will not be further described herein, since they are not the subject matter of this invention.

DESCRIPTION OF THE PREFERRED EMBODIMENT

The upper end of drawer side 1 is provided with a running flange 3 which forms together with a supporting rail 4, which is fastened to a furniture side wall, a pull-out guide of the drawer.

The bottom plate 2 is provided with a continuous groove 5 on the bottom of each side. Each drawer side wall 1 includes, below the upper running flange 3, a central vertical flange 7, which forms the lateral limitation of the drawer, and a lower horizontal flange 8 on which the bottom plate 2 abuts. The running flange 3 rests on a supporting roller (not shown) on the side of the furniture body.

Flaps 9 are punched out from the lower horizontal flange 8 of each drawer side wall 1.

Figure 3:
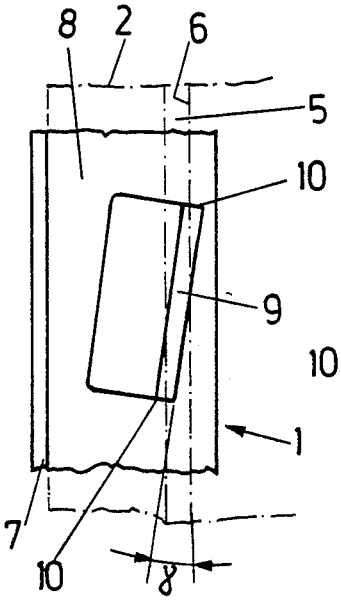
FIG. 3 is a top view of the drawer side wall in the region of a flap.
Figure 4:
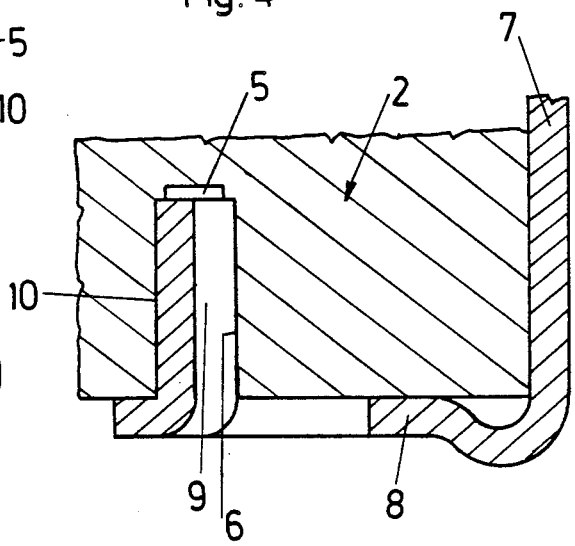
FIG. 4 is a vertical sectional view of the drawer side wall and the bottom plate in the region of a flap.

As can particularly be seen from FIGS. 1 and 3, the flaps 9 are, when viewed from the top, aligned obliquely to the respective groove 5 of the bottom plate 2 and extend at an angle $\alpha$ with the groove 5.

When the bottom plate 2 is pressed onto the horizontal flange 8, the edges 10 of the flaps 9 are forced into the side walls 6 of the groove 5, whereby a clamping effect is obtained. The obliquely positioned flaps 9 prevent a displacement of the bottom plate 2 with respect to the drawer side walls 1 in the pull-out direction of the drawer, i.e. in the direction in which the greatest forces occur during normal use of the drawer. The flaps 9 are advantageously parallel to one another, with corresponding vertical edges 10 of the flaps being aligned with one another.

What is claimed is:

1. A drawer comprising:

metal side walls having vertical flanges which form lateral limitations of said drawer, each said side wall having at a lower part thereof a respective horizontal flange;

a bottom plate abutting on said horizontal flanges, said bottom plate having parallel lateral edges and a pair of longitudinal grooves extending parallel to said lateral edges; and said horizontal flanges having extending therefrom a plurality of flaps extending into said grooves, said flaps extending obliquely to the longitudinal direction of said grooves, such that opposite end edges of each said flap are pressed into respective spaced walls of said bottom plate that define the respective said groove.

2. A drawer as claimed in claim 1, wherein each said flap is mounted out from the material of the respective said horizontal flange and extends upwardly therefrom.

3. A drawer as claimed in claim 1, comprising plural said flaps extending from each said horizontal flange.

4. A drawer as claimed in claim 3, wherein all said flaps extending from each said horizontal flange are parallel to each other.

5. A drawer as claimed in claim 4, wherein each said flap has a forward substantially vertical edge and a rearward substantially vertical edge, said forward edges of all said flaps of each said horizontal flange being aligned in a rectilinear direction parallel to the respective said groove, and said rearward edges of all said flaps of each said horizontal flange being aligned in a rectilinear direction parallel to the respective said groove.

* * * * *